US010415883B2

(12) United States Patent
Zheng et al.

(10) Patent No.: US 10,415,883 B2
(45) Date of Patent: Sep. 17, 2019

(54) REFRACTORY PROTECTION LAYER FOR METALLURGICAL FURNACE

(71) Applicant: CHINA ENFI ENGINEERING CORPORATION, Beijing (CN)

(72) Inventors: Budong Zheng, Beijing (CN); Zhenmin Zhang, Beijing (CN); Liyu Lu, Beijing (CN); Kefei Cao, Beijing (CN); Dawei Cui, Beijing (CN); Chuangu Wu, Beijing (CN); Haikuo Sun, Beijing (CN)

(73) Assignee: CHINA ENFI ENGINEERING CORPORATION, Beijing (CN)

( * ) Notice: Subject to any disclaimer, the term of this patent is extended or adjusted under 35 U.S.C. 154(b) by 227 days.

(21) Appl. No.: 15/384,380

(22) Filed: Dec. 20, 2016

(65) Prior Publication Data

US 2018/0172350 A1 Jun. 21, 2018

(51) Int. Cl.
*F27D 1/00* (2006.01)
*F27D 1/04* (2006.01)

(52) U.S. Cl.
CPC ..... *F27D 1/0006* (2013.01); *F27D 1/0033* (2013.01); *F27D 1/0043* (2013.01); *F27D 1/045* (2013.01)

(58) Field of Classification Search
USPC ..... 432/238
See application file for complete search history.

(56) References Cited

U.S. PATENT DOCUMENTS 3,218,050 A * 11/1965 Healy ..... H05B 7/02 266/286
6,227,127 B1 * 5/2001 Yamaguchi ..... C04B 35/443 110/323
2014/0217655 A1 * 8/2014 Piret ..... C04B 35/66 266/280

FOREIGN PATENT DOCUMENTS

CN 204255081 * 12/2014

* cited by examiner

*Primary Examiner* — Steven B McAllister
*Assistant Examiner* — John E Bargero
(74) *Attorney, Agent, or Firm* — Hodgson Russ LLP

(57) ABSTRACT

The present disclosure discloses a refractory protection layer for a metallurgical furnace, which includes a insulating layer, a permanent layer built with a refractory brick and arranged on the insulating layer, a working layer built with a refractory brick and arranged on the permanent layer, and a first anti-permeation layer made of ramming mass and arranged on the working layer. The refractory protection layer for the metallurgical furnace described in the present disclosure embodiments has both high temperature resistance and good permeability resistance.

8 Claims, 2 Drawing Sheets

REFRACTORY PROTECTION LAYER FOR METALLURGICAL FURNACE

FIELD

The present disclosure relates to the technical field of smelting, and particularly to a refractory protection layer for a metallurgical furnace.

BACKGROUND

In the related field, the refractory protection layer at the bottom of the metallurgical furnace is usually built with refractory bricks, which are locked mutually to avoid the phenomenon of "floating bricks" in the smelting process. However, the refractory protection layer of the metallurgical furnace in some situations, especially at the furnace bottom (especially the round bottom), has poor anti-permeability and anti-erosion property because there are still joints between the refractory bricks. The high temperature metal in the furnace will penetrate into the housing of furnace bottom and will damage the housing, which affects the service life and usage of the metallurgical furnace.

SUMMARY

The present disclosure aims to solve at least one of the technical problems to some extent. Thus, one objective of the present disclosure is to put forward a refractory protection layer for a metallurgical furnace with better refractory property and permeability resistance.

The refractory protection layer for the metallurgical furnace according to the present disclosure includes an insulating layer, a permanent layer built with a refractory brick and arranged on the insulating layer, a working layer built with the refractory brick and arranged on the permanent layer, and a first anti-permeation layer made of ramming mass and arranged on the working layer.

The refractory protection layer for the metallurgical furnace described in the present disclosure embodiments has not only high temperature resistance but good permeability resistance.

Preferably, the refractory protection layer also includes a second anti-permeation layer made of ramming mass and arranged between the mentioned insulating layer and the permanent layer.

Preferably, side faces of adjacent refractory bricks of the working layer are butted or dislocated partially, and the side faces are slanted.

Preferably, the refractory brick of the working layer has a four-sided truncate or wedged shape.

Preferably, a shielding layer is arranged between the working layer and the first anti-permeation layer to cover joints between refractory bricks of the working layer.

Preferably, the refractory brick of the working layer and/or permanent layer is one of a magnesia brick, a magnesia-chrome brick, a magnesia-alumina brick, a magnesia-carbon brick, an aluminum-chrome brick, a carbon brick and a carborundum brick.

Preferably, the insulating layer is built with clay bricks or high-alumina bricks.

REFERENCE SIGNS

Figure 1:
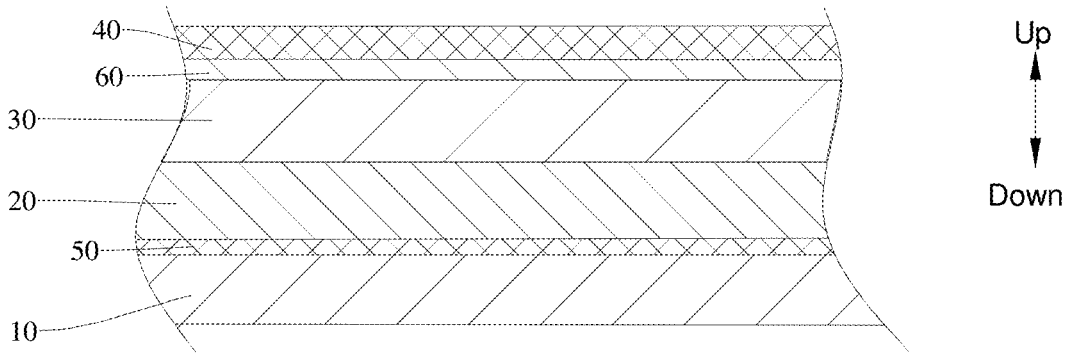
FIG. 1 is a schematic view of a refractory protection layer for a metallurgical furnace according to an embodiment of the present disclosure.

Refractory protection layer 100; insulating layer 10; permanent layer 20; working layer 30; refractory brick 31; first anti-permeation layer 40; second anti-permeation layer 50; shielding layer 60.

DETAILED DESCRIPTION

The embodiments of the present disclosure will be described below in detail, and the described embodiments are shown in attached drawings. The marked numbers which are totally the same or similar represent the same or similar elements, or the element with same or similar functions. The following reference embodiments in attached drawings are examples which are only used for explaining the present disclosure, but cannot be understood as a restriction to the present disclosure.

Referring to FIG. 1, a refractory protection layer 100 for a metallurgical furnace according to embodiments of the present disclosure is described below.

As shown in FIG. 1, the refractory protection layer 100 for the metallurgical furnace according to an embodiment of the present disclosure includes an insulating layer 10, a permanent layer 20 built with a refractory brick and arranged on the insulating layer 10, a working layer 30 built with a refractory brick and arranged on the permanent layer 20, and a first anti-permeation layer 40 made of ramming mass and arranged on the working layer 30.

The refractory protection layer 100 for the metallurgical furnace according to the embodiment of the present disclosure is sequentially stacked with the insulating layer 10, the permanent layer 20, and the working layer 30 as a whole. The permanent layer 20 and working layer 30 are built with the refractory brick to make the protection layer have good refractory property. And the first anti-permeation layer 40 made of ramming mass is arranged above the working layer 30 to cover joints between refractory bricks of working layer 30, which makes the refractory protection layer 100 have a good anti-permeability.

In a preferred embodiment, the refractory protection layer also includes a second anti-permeation layer 50 made of ramming mass and arranged between the insulating layer 10 and permanent layer 20. In this way, the second anti-permeation layer 50 is arranged between the insulating layer 10 and permanent layer 20 to further enhance the permeability resistance of refractory protection layer 100. Those skilled in the art can understand that a specific thickness and a composition of ramming mass of the first anti-permeation layer 40 and the second anti-permeation layer 50 can be set according to requirements.

Figure 2:
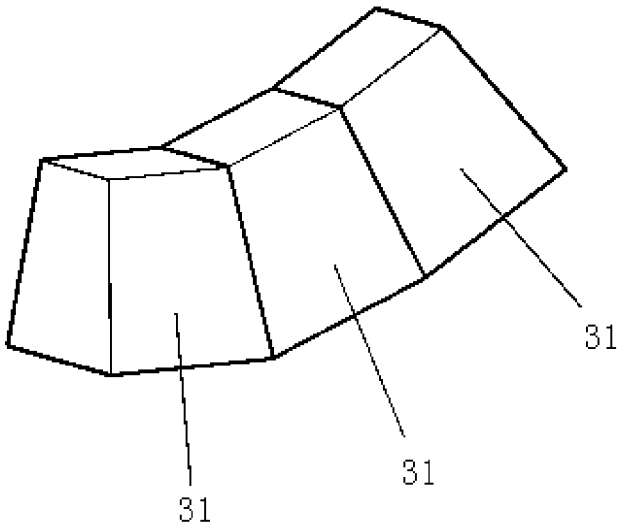
FIG. 2 is a schematic view of butt joint of refractory bricks of a working layer according to an embodiment of the present disclosure.
Figure 3:
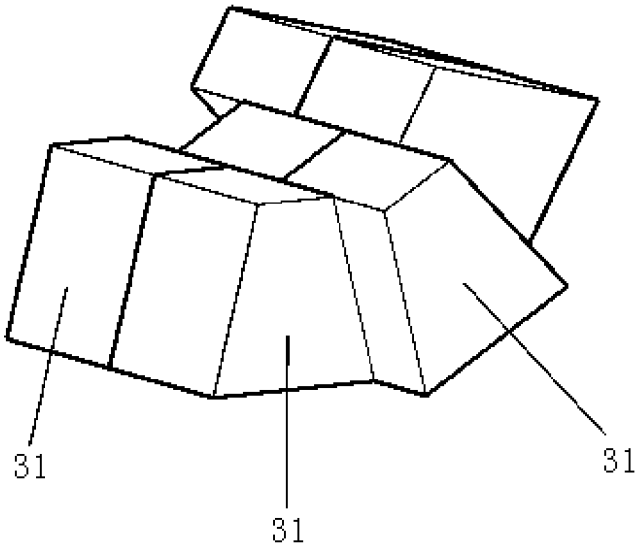
FIG. 3 is a schematic view of partial dislocation of refractory bricks of a working layer according to an embodiment of the present disclosure.

Advantageously, side faces of adjacent refractory bricks 31 of the working layer 30 are butted or dislocated partially, in which the side faces are slanted. Specifically, in the specific example shown in FIG. 2, two adjacent refractory bricks of working layer 30 are butted, namely, side faces of the two refractory bricks 31 overlap completely. In the specific example shown in FIG. 3, two adjacent refractory bricks 31 of the working layer 30 dislocated partially, namely, side faces of the two refractory bricks 31 only partially overlap.

Figure 4:
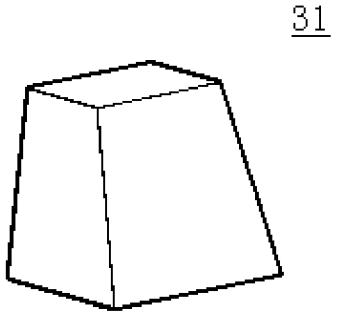
FIG. 4 is a schematic view of a four-sided truncate refractory brick of a working layer according to an embodiment of the present disclosure.
Figure 5:
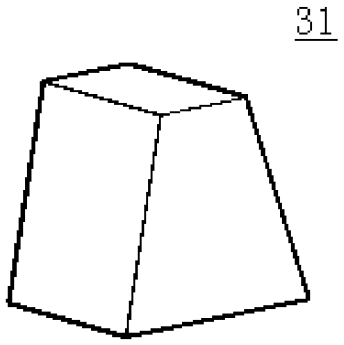
FIG. 5 is a schematic view of a wedged refractory brick of the working layer according to the embodiment of the present disclosure.

Further, a refractory brick 31 of the working layer 30 has a four-sided truncate or wedged shape. Specifically, in the specific example shown in FIG. 4, a refractory brick 31 of the working layer 30 has a four-sided truncate shape whose extension lines of four chamfered edges intersect in one point. In the specific example shown in FIG. 5, a refractory brick 31 of the working layer 31 has a wedged shape whose extension lines of four chamfered edges intersect in a straight line. As a result, adjacent refractory bricks of the working layer 30 are locked tightly to make the inner connection of refractory protection layer 100 tight and reliable.

According to FIG. 1, a shielding layer 60 is also arranged between the working layer 30 and the first anti-permeation layer 40 to cover joints between refractory bricks of the working layer 30. As a result, the shielding layer 60 covers the joints of the working layer 30 to prevent foreign bodies from entering the joints of the working layer 30.

A refractory brick of a working layer 30 and/or a permanent layer 20 is one of a magnesia brick, a magnesia-chrome brick, a magnesia-alumina brick, a magnesia-carbon brick, an aluminum-chrome brick, a carbon brick and a carborundum brick. Thus the high temperature resistance and erosion property resistance of the refractory protection layer are increased.

Preferably, the insulating layer 10 is built with clay bricks or high-alumina bricks. As a result, the insulating layer 10 has the advantages of heat insulation, sound insulation and moisture absorption.

When the refractory protection layer of the present disclosure examples is used in a metallurgical furnace, a furnace bottom of the metallurgical furnace adopts refractory protection layer. The insulating layer 10 forms the outer side of the furnace bottom. The first anti-permeation layer 40 forms the inner side of the furnace bottom. In the process of starting and heating up of the metallurgical furnace, the first anti-permeation layer 40 can prevent molten metal in the metallurgy furnace from entering the working layer 30. After the temperature of the metallurgical furnace bottom is raised and maintained for a period, the refractory brick of the working layer 30 fully expands and the joints between adjacent refractory bricks are fully bridged. Even if the first anti-permeation layer 40 wears, the joints in the working layer 30 have been closed, which still can prevent the molten metal in the metallurgy furnace from entering the working layer 30.

In the description of the present disclosure, the terms of "up" and "down" and other indicated orientations or positional relations are based on the orientations or positional relations shown in attached drawings, which are just for the convenience of describing the present disclosure and simplifying description, but not mean or hint that the indicated device or element must have the specific orientation, or be constructed and operated by the specific structure and orientation, thus it shall not be understood as a restriction to the present disclosure.

In addition, the terms of "first" and "second" are just used for describing the purpose, but shall not be understood to mean or hint relative importance or implicitly indicate the number of indicated technical feature. Thus, the characteristics of "first" and "second" in the restriction can explicitly or implicitly include at least one of the characteristics. In the description of the present disclosure, the meaning of "multiple" means at least two, such as two, three, etc., unless otherwise specified.

In the present disclosure, the terms of "install", "connect together", "connection" and "fixed" shall be generally understood unless otherwise clearly stipulated and limited, such as: it can be permanent connection, detachable connection or integrally connect; can be mechanical connection, or electric connection; can be directly connected, or indirectly connected by intermediation; can be inter connection of two elements or interaction relationship or two elements, unless otherwise specified. As for the ordinary technical personnel in this Field, they can understand the specific meaning of above terms in the present disclosure according to the specific circumstance.

In the present disclosure, unless otherwise clearly stipulated and limited, the first feature is "on" or "below" the second feature, which means the first and second feature have direct contact, or the first and second feature have indirect contact through intermediation. And the first feature is "above", "upper" and "on" the second feature, which means the first feature is right above or not quite right above the second feature, or just shows the level of first feature is higher than that of second feature. The first feature is "below", "under" and "down" the second feature, which means the first feature is right below or not quite right below the second feature, or just shows the level of first feature is lower than that of second feature.

In the description of the Specification, the description of reference terms of "an embodiment", "some embodiments", "example", "specific example" or "some examples" means combining with specific characteristic, structure, material described by examples or exploit examples or features that are contained in at least one embodiment or example of the present disclosure. In the Specification, the schematic expression of above terms not always means the same example or embodiment. What's more, the described specific characteristic, structure or feature can be combined in one or more examples or embodiments by a proper way. In addition, the technical personnel in the field can bind and combine the different examples or embodiments described in the Specification and the characteristics of different examples or embodiments under conditions of non-contradiction.

Although the embodiments of the present disclosure has been shown and described above, it is understandable that the above mentioned embodiments are examples, and cannot be understood as the limitation for the present disclosure. The ordinary technical personnel in the field of can change, modify, replace and deform the above mentioned embodiments in the range of the present disclosure.

What is claimed is:

1. A refractory protection layer for a metallurgical furnace, comprising:

an insulating layer, a permanent layer built with a refractory brick and arranged on the insulating layer, a working layer built with the refractory brick and arranged on the permanent layer, and a first anti-permeation layer made of ramming mass and arranged on the working layer;

a second anti-permeation layer made of ramming mass and arranged between the insulating layer and the permanent layer;

wherein the refractory protection layer is applied to a bottom wall of the metallurgical furnace;

wherein a shielding layer is arranged between the working layer and the first anti-permeation layer to cover joints between refractory bricks of the working layer.

2. The refractory protection layer according to claim 1, wherein side faces of adjacent refractory bricks of the working layer are butted or dislocated partially, and the side faces are slanted.

3. The refractory protection layer according to claim 2, wherein the refractory brick of the working layer has a four-sided truncate or wedged shape.

4. The refractory protection layer according to claim 1, wherein a shielding layer is arranged between the working layer and the first anti-permeation layer to cover joints between refractory bricks of the working layer.

5. The refractory protection layer according to claim 2, wherein a shielding layer is arranged between the working layer and the first anti-permeation layer to cover joints between refractory bricks of the working layer.

6. The refractory protection layer according to claim 3, wherein a shielding layer is arranged between the working layer and the first anti-permeation layer to cover joints between refractory bricks of the working layer.

7. The refractory protection layer according to claim 1, wherein the refractory brick of the working layer and/or permanent layer is one of a magnesia brick, a magnesia-chrome brick, a magnesia-alumina brick, a magnesia-carbon brick, an aluminum-chrome brick, a carbon brick and a carborundum brick.

8. The refractory protection layer according to claim 1, wherein the insulating layer is built with clay bricks or high-alumina bricks.

* * * * *